US007563094B2

(12) United States Patent
Yang

(10) Patent No.: US 7,563,094 B2
(45) Date of Patent: Jul. 21, 2009

(54) UTILITY LIGHTER

(76) Inventor: John Yang, 15443 Proctor Ave., #B, Industry, CA (US) 91745

( * ) Notice: Subject to any disclaimer, the term of this patent is extended or adjusted under 35 U.S.C. 154(b) by 198 days.

(21) Appl. No.: 11/652,943

(22) Filed: Jan. 12, 2007

(65) Prior Publication Data

US 2008/0171295 A1 Jul. 17, 2008

(51) Int. Cl.
*F23Q 13/04* (2006.01)
*F23Q 2/16* (2006.01)
*F23Q 2/34* (2006.01)

(52) U.S. Cl. ..... 431/153; 431/255; 431/344; 431/345

(58) Field of Classification Search ..... 431/115, 431/153, 255, 344, 345
See application file for complete search history.

(56) References Cited

U.S. PATENT DOCUMENTS 1,516,655 A * 11/1924 Percy ..... 239/416.4
2,203,210 A * 6/1940 Young ..... 239/588
2,345,385 A * 3/1944 Dohrn et al. ..... 548/367.4
3,674,413 A * 7/1972 Fraser ..... 431/344
D241,645 S * 9/1976 Lanzi ..... D7/416
4,538,983 A * 9/1985 Zeller et al. ..... 431/255
5,154,483 A * 10/1992 Zeller ..... 362/198
5,199,865 A * 4/1993 Liang ..... 431/255
5,284,439 A * 2/1994 Shike et al. ..... 431/263
5,369,556 A * 11/1994 Zeller ..... 431/344
5,531,592 A * 7/1996 Tasi ..... 431/255
5,738,507 A * 4/1998 Mifune et al. ..... 431/344
6,095,801 A * 8/2000 Spiewak ..... 431/344
6,213,759 B1 * 4/2001 Sung ..... 431/153
6,398,545 B1 * 6/2002 Kleeman et al. ..... 431/327
6,468,070 B1 * 10/2002 Jon ..... 431/153
6,648,630 B2 * 11/2003 Tse ..... 431/153
6,887,072 B2 * 5/2005 Judeng ..... 431/153
6,997,702 B1 * 2/2006 Chen ..... 431/344
7,011,515 B1 * 3/2006 Hsu ..... 431/126

* cited by examiner

*Primary Examiner*—Carl D Price
(74) *Attorney, Agent, or Firm*—Raymond Y. Chan; David and Raymond Patent Firm

(57) ABSTRACT

A utility lighter includes a handle casing, a gas releasing valve, a bendable extension arm, a torch nozzle, a piezoelectric unit and an actuation device. The bendable extension arm has an upper end and a lower end extended from the handle casing, wherein the extension arm has a deformable receiving channel which is extended from the lower end to the upper end and is adapted to be curved when the extension arm is selectively bent between the upper end and the lower end. The torch nozzle is provided at the upper end of the extension arm to communicate with the gas releasing valve through the receiving channel for releasing the gas through the torch nozzle when the actuation device is actuated to depress the piezoelectric unit. The result is that a torch flame is generated at the torch nozzle at a distance from the handle casing.

10 Claims, 6 Drawing Sheets

UTILITY LIGHTER

BACKGROUND OF THE PRESENT INVENTION

1. Field of Invention

The present invention relates to a lighter, and more particularly to a utility lighter which is capable of igniting a torch flame at a distance from the lighter casing.

2. Description of Related Arts

A conventional utility lighter comprises a lighter casing having a fuel storage chamber for storing a predetermined amount of liquefied gas, a gas releasing valve communicated with the fuel storage chamber for releasing the liquefied gas when the gas releasing valve is uplifted, a flexible extension tube extended between the lighter casing and the ignition nozzle, an ignition nozzle provided at the top end portion of the extension tube, a piezoelectric unit, and an actuation button. The piezoelectric unit comprises a main body, a depressible part movably extended from the main body, and a spark generating tip extended from the main body to the ignition nozzle via the flexible extension tube, in such a manner that when the depressible part is depressed, a spark will be generated at the spark-generating tip for igniting the utility lighter.

The operation of this conventional utility lighter is as follows: when the actuation button is depressed by a user, the actuation button is arranged to depress the depressible part of the piezoelectric unit to produce a spark at the spark-generating tip, and simultaneously uplift the gas releasing valve for releasing the gas at the ignition nozzle. Thus, when the gas is ignited by the spark, a flame is produced at the ignition nozzle for igniting a desired object.

There exist several disadvantages in relation to this kind of conventional utility lighter. First, the lighter flame produce by the conventional utility lighter is vulnerable to wind. Unfortunately, however, utility lighters are frequently used in outdoor environment. Thus, when the utility lighter is used in a windy environment, the flame may go out very frequently and this presents an inconvenience scenario for the user of the conventional utility lighter.

Second, for conventional utility lighters such as the one described above, the flame is a regular lighter flame which is oriented in an upward direction irrespective of the orientation of the extendable tube. Thus, when the user needs to ignite something which is not aligned with the orientation of the flame, he or she has only two solutions to solve the problem. First, he or she may manually turn the lighter casing such that the orientation of the lighter flame matches with the target object. Although this may solve the particular problem at hands, there may well be circumstances that this solution cannot work at all. For example, when the users need to use the utility lighter in a confined area, he or she may not be able to turn the lighter casing very conveniently. Second, instead of using a utility lighter, the user may use a torch (a windproof) lighter for igniting the target object. However, the problem for this particular solution is that for conventional windproof lighters, the flame ignition nozzle is so close to the lighter casing that the user may not be able or desire to place the lighter casing at that position. For example, when the user needs to ignite a stove, he or she definitely does not wish to put the lighter casing, and most importantly, his or her hands, too close to the stove, for obvious safety reason.

Third, since the distance between the ignition nozzle and the gas releasing valve of conventional utility lighter is fairly long, there exists the possibility that when the user stops igniting the lighter, residual gas retained within the gas tube connecting the gas releasing valve and the ignition nozzle will continuously flow out from the gas tube via the ignition nozzle. In such scenario, residual ignition at the ignition nozzle nevertheless persists even though the user stops igniting the utility lighter. This is dangerous.

A word about the conventional windproof lighters. For most of the conventional windproof lighters, they have not been designed to support prolonged ignition. Thus, there is little, if any, measure which has been employed to prevent the high temperature of the torch flame from transmitting to the users' hands and the respective lighter casing. As a result, although in many circumstances, a torch flame is preferred, the conventional mechanical structure of conventional windproof lighters is such that the user may not wish to use them for their specific purposes.

SUMMARY OF THE PRESENT INVENTION

A main object of the present invention is to provide a utility lighter which is capable of igniting a torch flame at a distance from the lighter casing.

Another object of the present invention is to provide a utility lighter comprising a bendable extension arm which is capable of conducting piezoelectricity from a piezoelectric unit to an upper end portion of the bendable extension arm so as to assist production of the torch flame at a torch nozzle. In other words, the inherent physical nature of the utility lighter of the present invention assists its operation.

Another object of the present invention is to provide a utility lighter comprising a heat insulating arrangement which is capable of substantially preventing the high temperature from transmitting to the user's hand even after extended ignition (e.g. ignition for around ten seconds) of the torch flame.

Another object of the present invention is to provide a utility lighter comprising a safety arrangement for preventing accidental ignition of the torch flame.

Another object of the present invention is to provide a utility lighter which is capable of preventing unwanted residual ignition when the user stops igniting the utility lighter. Thus, the present invention aims to maintain maximum safety for the user.

Another object of the present invention is to provide a utility lighter which does not involve complicated or expensive mechanical components so as to minimize the manufacturing cost of the present invention.

Accordingly, in order to accomplish the above objects, the present invention provides a utility lighter, comprising:

a handle casing having a fuel storage compartment formed therein for storing a predetermined amount of liquefied gas;

a gas releasing valve provided at the fuel storage compartment for releasing the gas therein in a controllable manner;

a bendable extension arm having an upper end and a lower end extended from the handle casing, wherein the extension arm has a deformable receiving channel which is extended from the lower end to the upper end and is adapted to be curved when the extension arm is selectively bent between the upper end and the lower end;

a torch nozzle provided at the upper end of the extension arm to communicate with the gas releasing valve through the receiving channel for releasing the gas through the torch nozzle;

a piezoelectric unit, which is supported in the handle casing, having a depressible part and a spark-generating element extended at a position that when the depressible part of the piezoelectric unit is depressed, the spark-generating element generates a spark at the torch nozzle to ignite the gas emitting therefrom so as to generate a torch flame; and an actuation device provided at the lighter casing to operatively couple with the depressible part of the piezoelectric unit and the gas releasing valve, wherein when the extension arm is selectively bent at a desired curvature to adjust a torch pointing direction of the torch nozzle, the actuation device is actuated to depress the depressible part of the piezoelectric unit and to simultaneously release the gas at the gas releasing valve to produce the torch flame at the nozzle torch at the torch pointing direction.

These and other objectives, features, and advantages of the present invention will become apparent from the following detailed description, the accompanying drawings, and the appended claims.

DETAILED DESCRIPTION OF THE PREFERRED EMBODIMENT

Figure 1:
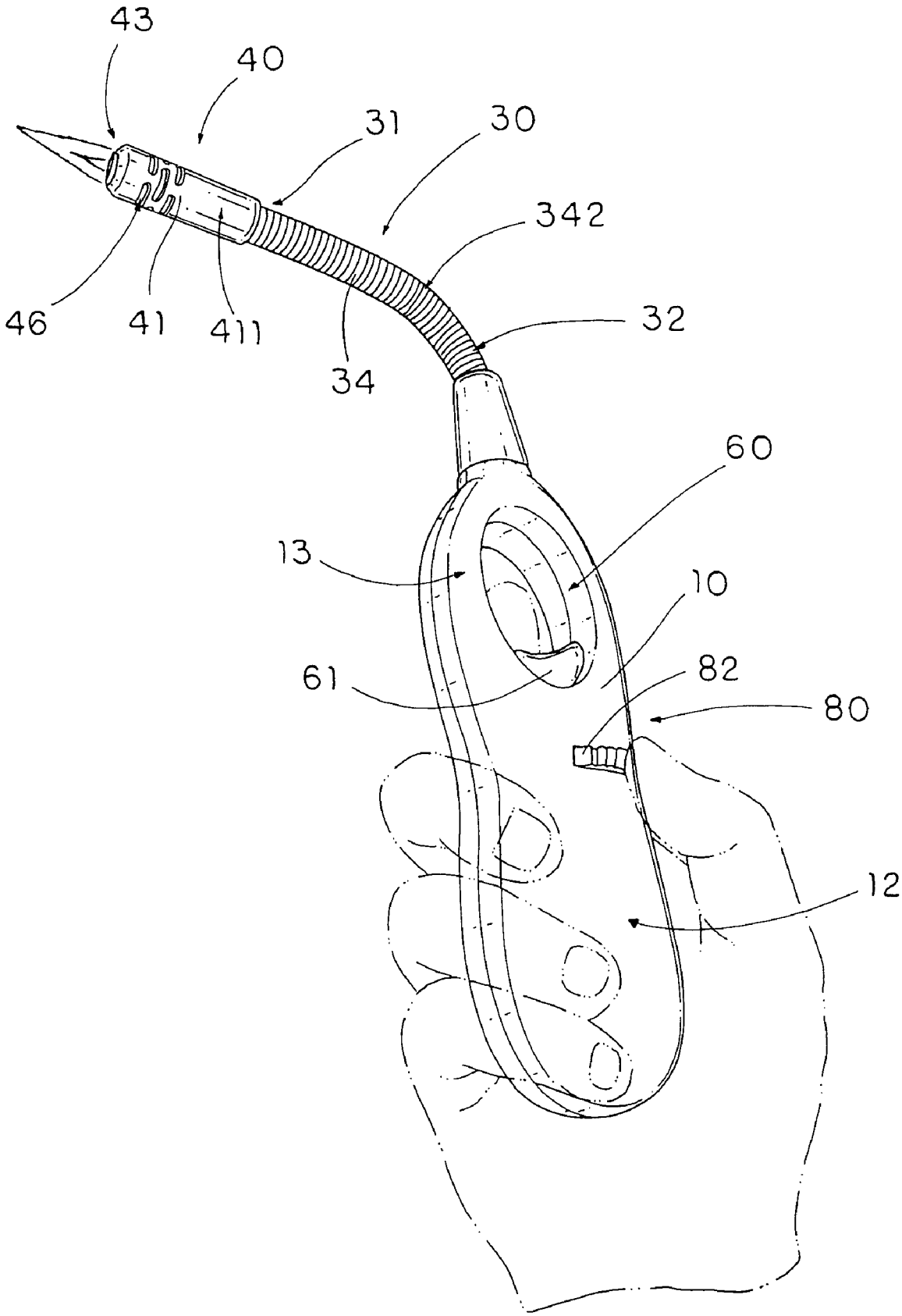
FIG. 1 is a perspective view of a utility lighter according to a preferred embodiment of the present invention.
Figure 2:
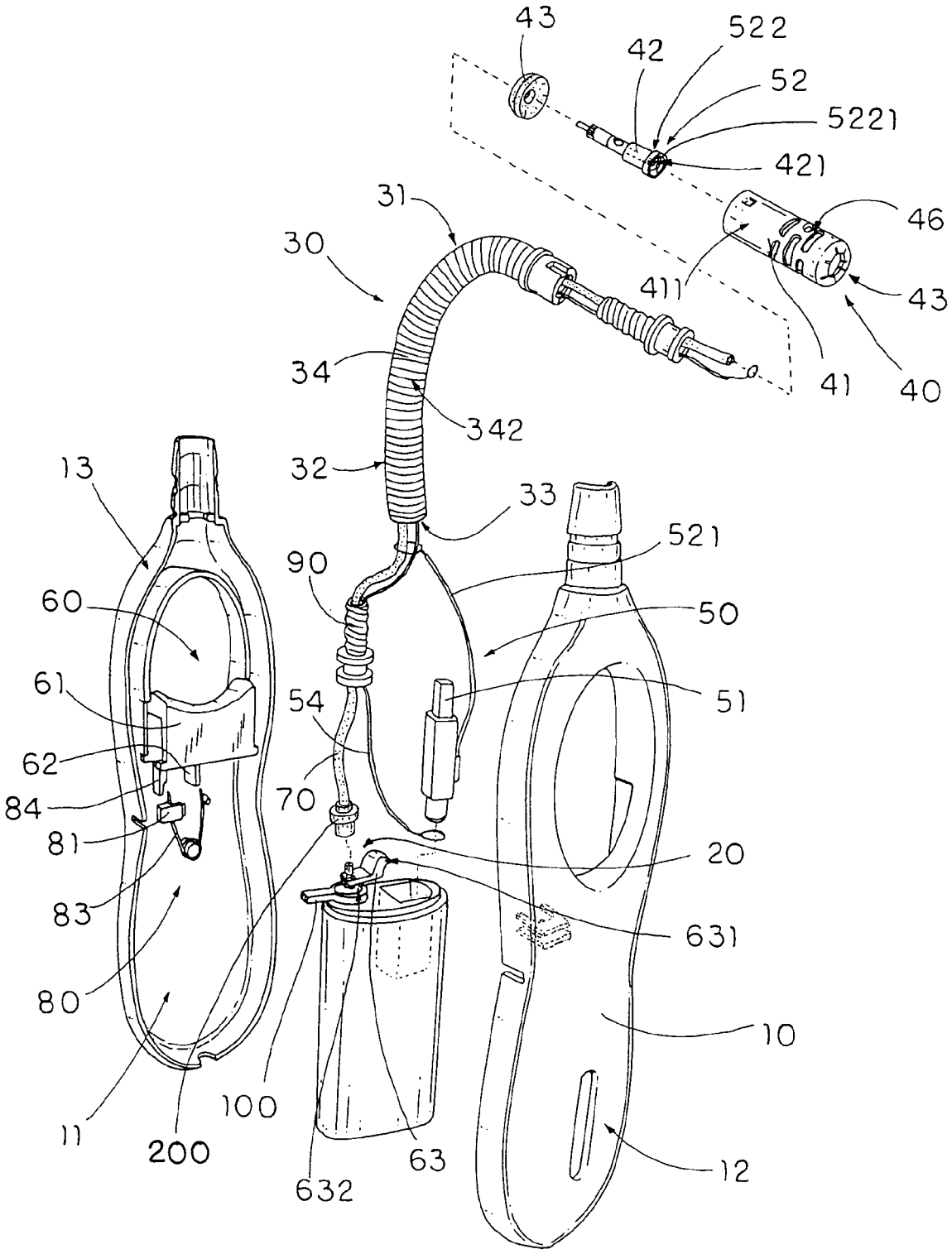
FIG. 2 is an exploded perspective view of the utility lighter according to the above preferred embodiment of the present invention.

Referring to FIG. 1 to FIG. 4 of the drawings, a utility lighter, such as a barbecue lighter, according to a preferred embodiment of the present invention is illustrated, in which the utility lighter comprises a handle casing 10, a gas releasing valve 20, a bendable extension arm 30, a torch nozzle 40, a piezoelectric unit 50, and an actuation device 60. The handle casing 10 has a fuel storage compartment 11 formed therein for storing a predetermined amount of liquefied gas. The gas releasing valve 20 is provided at the fuel storage compartment 11 for releasing the gas therein in a controllable manner when the gas releasing valve 20 is uplifted.

The bendable extension arm 30 has an upper end 31 and a lower end 32 extended from the handle casing 10, wherein the bendable extension arm 30 has a deformable receiving channel 33 which is extended from the lower end 32 to the upper end 31 and is adapted to be curved when the extension arm 30 is selectively bent between the upper end 31 and the lower end 32.

The torch nozzle 40 is provided at the upper end 31 of the extension arm 30 to communicate with the gas releasing valve 20 through the receiving channel 33 for releasing the gas through the torch nozzle 40.

The piezoelectric unit 50, which is supported in the handle casing 10, has a depressible part 51 and a spark-generating element 52 extended at a position that when the depressible part 51 of the piezoelectric unit 50 is depressed, the spark-generating element 52 generates a spark at the torch nozzle 40 to ignite the gas emitting therefrom so as to generate a torch flame.

The actuation device 60 is provided at the lighter casing 10 to operatively couple with the depressible part 51 of the piezoelectric unit 50 and the gas releasing valve 20, wherein when the extension arm 30 is selectively bent at a desired curvature to adjust a torch pointing direction of the torch nozzle 40, the actuation device 60 is actuated to depress the depressible part 51 of the piezoelectric unit 50 and to simultaneously release the gas at the gas releasing valve 20 to produce the torch flame at the torch nozzle 40 at the torch pointing direction.

According to the preferred embodiment of the present invention, the handle casing 10 has a lower handling portion 12 for a user's hand to grip thereon, and a top actuation portion 13 for mounting the actuation device 60, wherein the bendable extension arm 30 is upwardly and flexibly extended from the top actuation portion 13 to produce a torch flame at a distance from the handle casing 10 when the actuation device 60 is actuated.

In order to deliver the gas contained in the fuel storage compartment 11 to the torch nozzle 40, the gas-releasing valve 20 comprises a flexible gas tube 70 extending between the gas releasing valve 20 to the torch nozzle 40 via the lighter casing 10 and the deformable receiving channel 33 of the bendable extension arm 30, wherein when the gas releasing valve 20 is uplifted, the gas is released to the flexible gas tube 70 so as to be guided to reach the torch nozzle 40 for producing the torch flame thereat. Thus, when the bendable extension arm 30 is bent at a desired curvature, the flexible gas tube 70 is correspondingly bent for guiding the gas emitting from the gas releasing valve 20 to the torch nozzle 40 inside the bendable extension arm 30.

Figure 3:
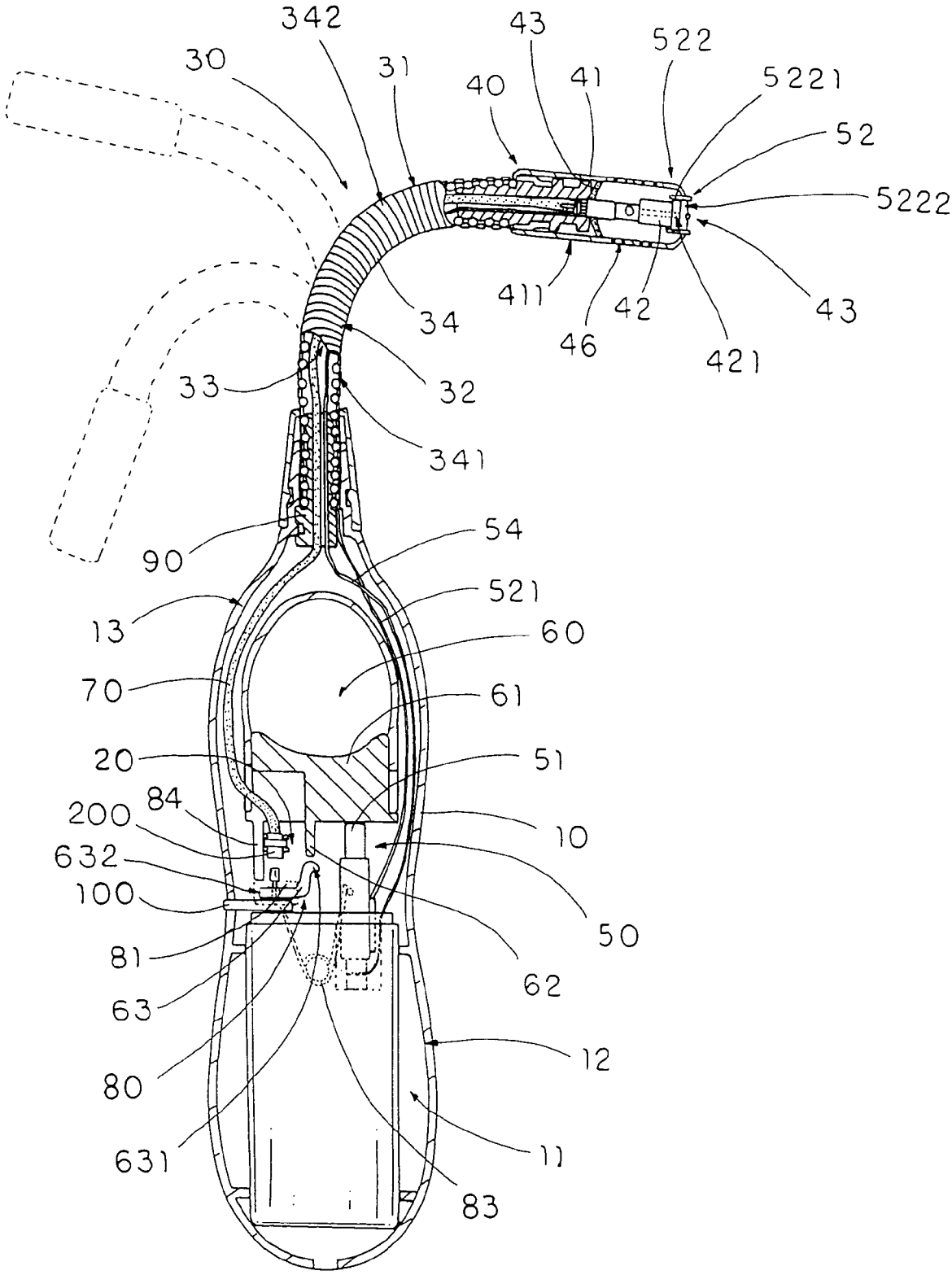
FIG. 3 is a schematic diagram of the utility lighter according to the above preferred embodiment of the present invention, illustrating that the utility lighter is idle.
Figure 4:
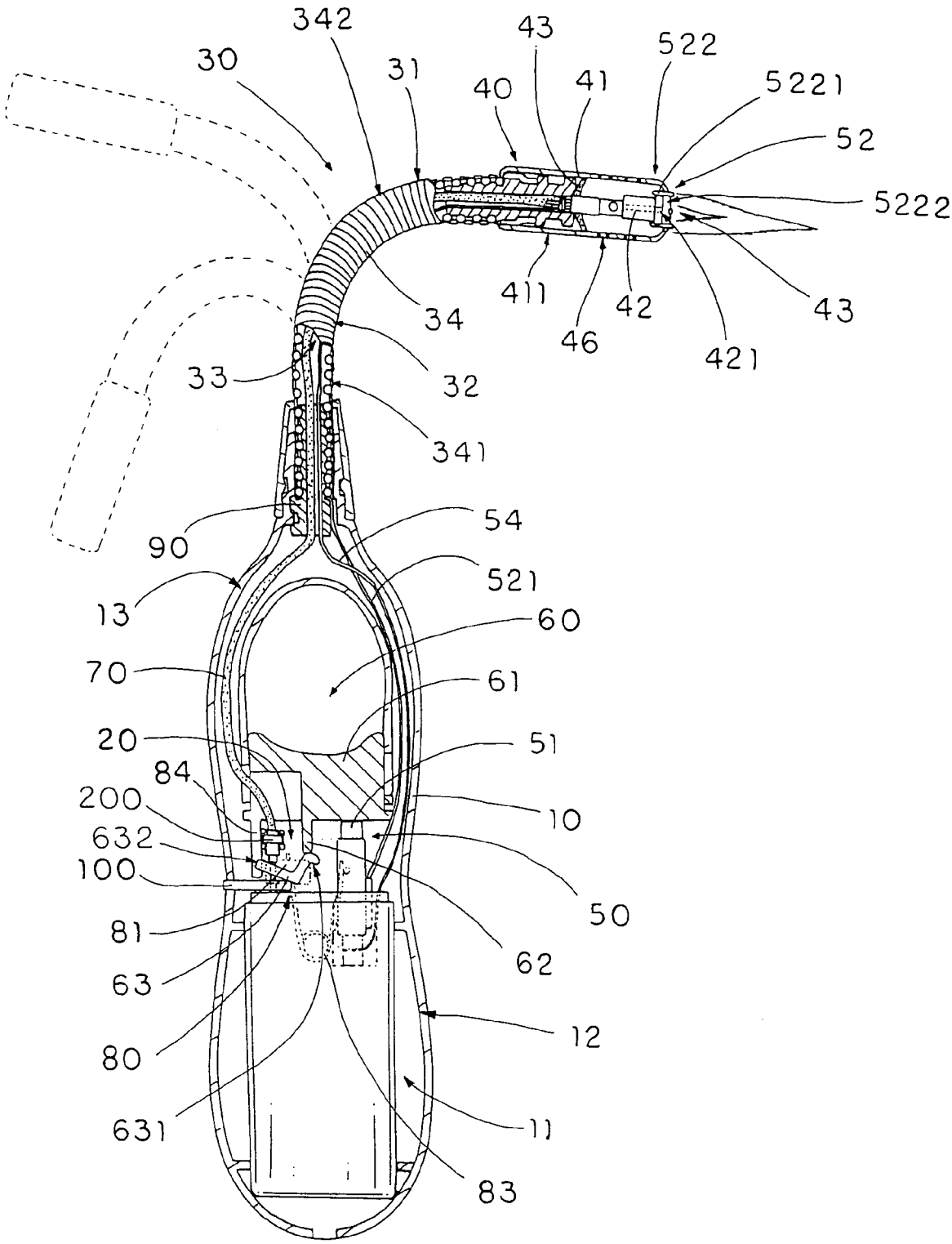
FIG. 4 is a schematic diagram of the utility lighter according to the above preferred embodiment of the present invention, illustrating that the utility is being ignited.

The bendable extension arm 30 comprises a tubular flexible arm body 34 wherein the deformable receiving channel 33 is formed within the flexible arm body 34 for allowing passage of the flexible gas tube 70 to pass therethrough. As shown in FIG. 3 to FIG. 4 of the drawings, the flexile arm body 34 has a bendable core portion 341 and a spiral portion 342 spacedly provided along the bendable core portion 341 to divide the bendable core portion 341 into a corresponding number of bending sections at the spiral portion 342, in such a manner that the bending section is adapted to bend at a predetermined curvature.

It is worth mentioning that the bendable extension arm 30 is made of a conductive material for conducting piezoelectricity from the piezoelectric unit 50 so as to produce a spark at the spark generating device 52 for igniting the torch flame at the torch nozzle 40.

The torch nozzle 40 comprises a nozzle housing 41 as a heat dissipating windshield provided at the upper end 31 of the bendable extension arm 30, and a nozzle head 42, having a contracted flame channel 421, communicated with the deformable receiving channel 33 of the bendable extension arm 30, in such a manner that when the gas is released to the flexible gas tube 70 which is extending in the deformable receiving channel 33, the contracted flame channel 421 is adapted to accelerate the gas for producing a windproof torch flame when the gas flow is ignited at the nozzle housing 41.

Moreover, the heat dissipating windshield, which is made of heat conductive metal, has a surrounding wall 411 mounted at the upper end 31 of the bendable extension arm 30 to enclose the torch nozzle 40, and a top opening 43 which is aligned with an emitting end of the torch nozzle 40 and is arranged when the gas is emitted at the emitting end of the torch nozzle 40 to form the torch flame towards the top opening 43 of the heat dissipating windshield, the heat of the torch flame is conducted and dissipated around the surrounding wall 411 of the heat dissipating windshield for minimizing the heat being transmitted towards the bendable extension arm 30.

The spark-generating element 52 is extended at a position to communicate with the surrounding wall 411 of the heat dissipating windshield such that the surrounding wall enhances a spark initiating surface for igniting the gas emitting from the torch nozzle 40 when the depressible part 51 of the piezoelectric unit 50 is depressed.

Thus, the piezoelectric unit 50 is disposed within the handle casing 10, wherein the spark-generating element 52 comprises a piezoelectricity conductor 521 defining a piezoelectric route extended from the piezoelectric unit 50 to the nozzle housing 41 of the torch nozzle 40, and a spark initiating platform 522 provided at the nozzle housing 41 for generating a piezoelectric spark when piezoelectricity is transmitted from the piezoelectric unit 50 to the spark initiating platform 522.

To describe the piezoelectric unit 50 in a more specific manner, the piezoelectric conductor 521 preferably comprises a plurality of conducting wires extended from the piezoelectric unit 50 to the spark initiating platform 522 via the bendable extension arm 30 so as to define the piezoelectric route as the conducting wires 5211 and a conductive portion of the bendable extension arm 30. In other words, the conducting wires are electrically connected with the conductive portion of the bendable extension arm 30 to form the piezoelectric route through which the piezoelectricity is transmitted from the piezoelectric unit 50 to the spark initiating platform 522 for generating the ignition spark thereat. It is worth mentioning that as a slight alternative, the conducting wires may be directly extended from the piezoelectric unit 50 to the spark initiating platform 522 via the deformable receiving channel 33 of the bendable extension arm 30 without utilizing the bendable extension arm 30 itself as a conductive medium.

In other words, the spark-generating element 52 is extended to the lower end 32 of the bendable extension arm 30 to communicate with the heat dissipating windshield such that the bendable extension arm 30 forms a conductive medium to transmit piezoelectricity to the heat dissipating windshield.

The spark initiating platform 522 preferably comprises a circular metallic body 5221 having a through ignition cavity 5222 formed therein to communicate with the flexible gas tube 70 so that the gas release from the gas-releasing valve 20 is allowed to reach the spark initiating platform 522 via the contract frame channel 421 of the nozzle housing 41. The circular metallic body 5222 has a surrounding boundary electrically connected to the piezoelectric route so that when the depressible part 51 of the piezoelectric unit 50 is depressed, piezoelectricity will be transmitted from the piezoelectric unit 50 to the circular metallic body 5222, wherein a spark is generated at the surrounding boundary of the circular metallic body 5222 in the ignition cavity 5222 for igniting the gas rapidly released from the contracted flame channel 421 of the nozzle head 42.

In order to enhance the product safety of the present invention, the piezoelectric unit 50 further comprises a piezoelectric ground wire 54 extended from the spark ignition platform 522 to an insulating materials, such as the plastic outer surface of the piezoelectric unit 50, for preventing electric shock by the user.

The torch nozzle 40 further comprises a heat insulating member 43 provided in the nozzle housing 41 for preventing the heat generated by the torch flame from transmitting into other part of the torch nozzle 40 and the bendable extension arm 30. More explicitly, the heat insulating member 43 is mounted at the nozzle housing 41 underneath the spark initiating platform 522 so that when the torch flame is generated upon ignition by the spark generated at the spark initiating platform 522, the heat insulating member 43 is arranged to block the heat of the torch flame from transmitting to the other part of the utility lighter so as to allow prolonged ignition of the torch flame by the utility lighter.

In order to further enhance heat insulating ability of the torch nozzle 40, the nozzle housing 41 as the heat dissipating windshield further has a plurality of heat dissipating slots 46 spacedly formed on the surrounding wall 411 in an array that each two of the adjacent heat dissipating slots 46 are formed on every other column for slowing down the heat transmitting towards the bendable extension arm 30, such that when the torch nozzle 40 emits the gas to form the torch flame toward the top opening 43, the heat dissipating windshield creates a sucking effect to suck surrounding air entering into the heat dissipating windshield through the heat dissipating slots 46 so as to cool down the surrounding wall 411 of the heat dissipating windshield.

Figure 6:
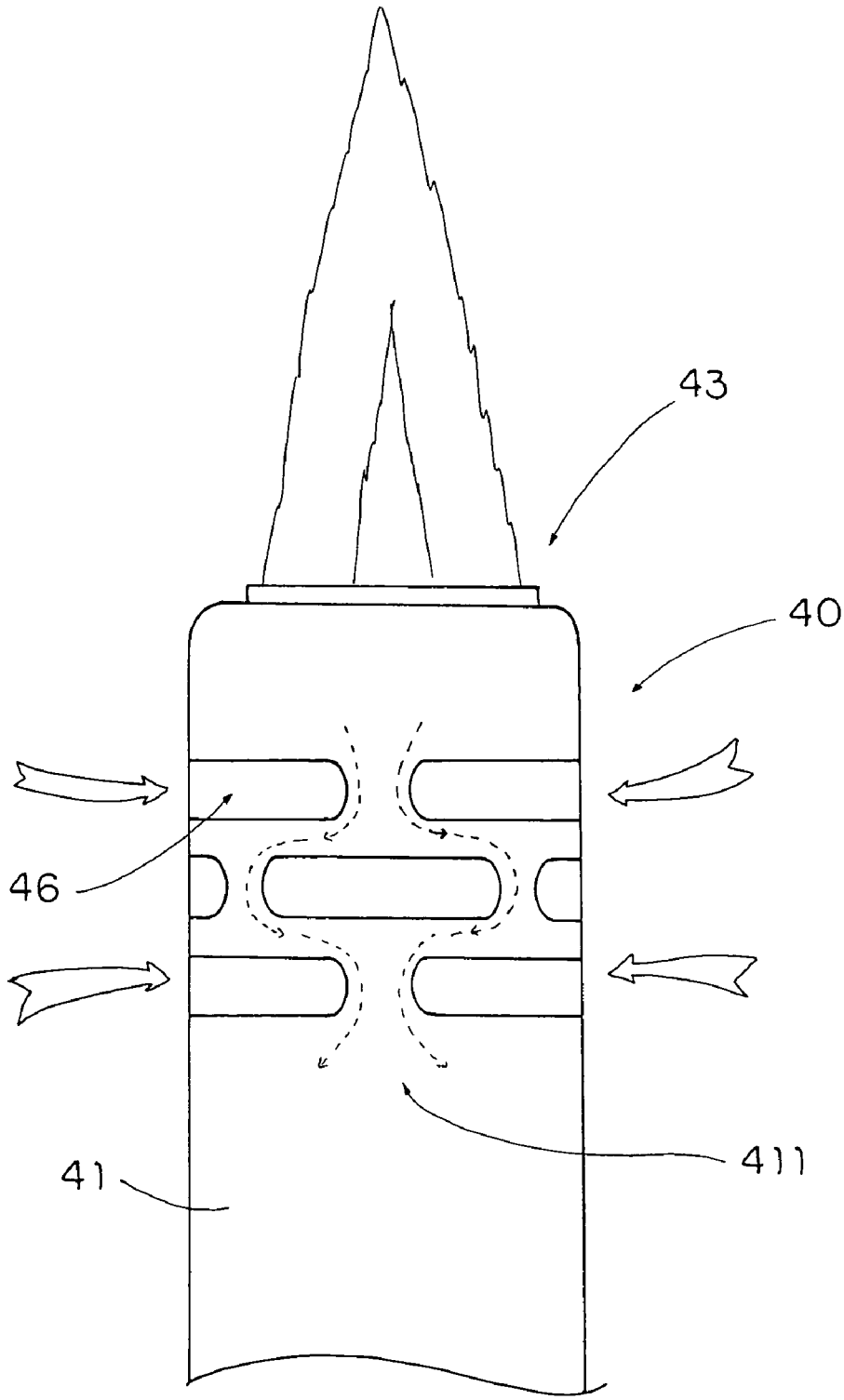
FIG. 6 is a schematic diagram of a heat dissipating windshield according to the above preferred embodiment of the present invention.

Referring to FIG. 6 of the drawings, it is worth mentioning that a distance between each heat dissipating slots 46 is minimized for diverting heat from the lighter flame down along the bendable extension arm 30. At the time the utility lighter is ignited, a certain amount of air is drawn to the heat dissipating windshield for producing effective ignition of the gas. In other words, the heat dissipating windshield ensures effective heat insulation as well as ignition of gas.

The utility lighter further comprises a sealing member 90 mounted at the lower end 32 of the bendable extension arm 30 to seal at the handle casing 10 for blocking heat from the torch flame through the extension arm 30 towards the handle casing 10.

The actuation device 60 comprises an actuation button 61 slidably mounted at the top actuation portion 13 of the handle casing 10, and a depressing member 62 downwardly extended from the actuation button 61 in such a manner that when the actuation button 61 is depressed, the depressing member 62 is depressed for uplifting the gas releasing valve 20 and the actuation button 61 is depressed to depress the depressible part 51 of the piezoelectric unit 50. Thus, the actuation device 60 further comprises an actuation lever 63 pivotally mounted in the handle casing 10 underneath the depressing member 62, wherein the actuation lever 63 has a depressible end 631 provided right underneath the depressing member 62, and a uplifting end 632 operatively mounted at the gas releasing valve 20 so such that when the depressing member 62 move downwardly to depress the depressible end 631 of the actuation lever 63, the uplifting end 631 is pivotally uplifted to uplift the gas releasing valve 20 so as to release gas toward the flexible gas tube 70.

According to the preferred embodiment of the present invention, the utility lighter further comprises a safety arrangement 80 comprising a blocking member 81 slidably provided within the handle casing 10 underneath the actuation lever 63, and a safety member 84 extended from the actuation button 61 to normally align with the blocking member, in such a manner that the safety arrangement 80 is adapted to operate between a safety position and ignition position, wherein at the safety position, the blocking member 81 is slid to block a downward pivotal movement of the safety member 84 so as to block a downward movement of the actuation device 60 for blocking depression of the depressible part 51 of the piezoelectric unit 50. When the safety arrangement 80 is at the ignition position, the blocking member 81 is slid away from the actuation lever 63 so as to allow the actuation button 61 to be depressed for depressing the actuation lever 63 to move pivotally for uplifting the gas releasing valve 20 and allow the actuation button 61 to depress the piezoelectric unit 50 so as to generate the spark at the spark initiating platform 522.

Thus, the safety arrangement 80 further comprises a safety controller 82 extended from the blocking member 81 out of the handle casing 10 for allowing the user to selectively switch the position (i.e. the safety position and ignition position) of the safety arrangement 80. Moreover, the safety arrangement 80 further comprises a resilient element 83 mounted within the handle casing 10 for normally exerting a urging force toward the blocking member 81 to normally retain the safety arrangement 80 at the safety position.

Figure 5B:
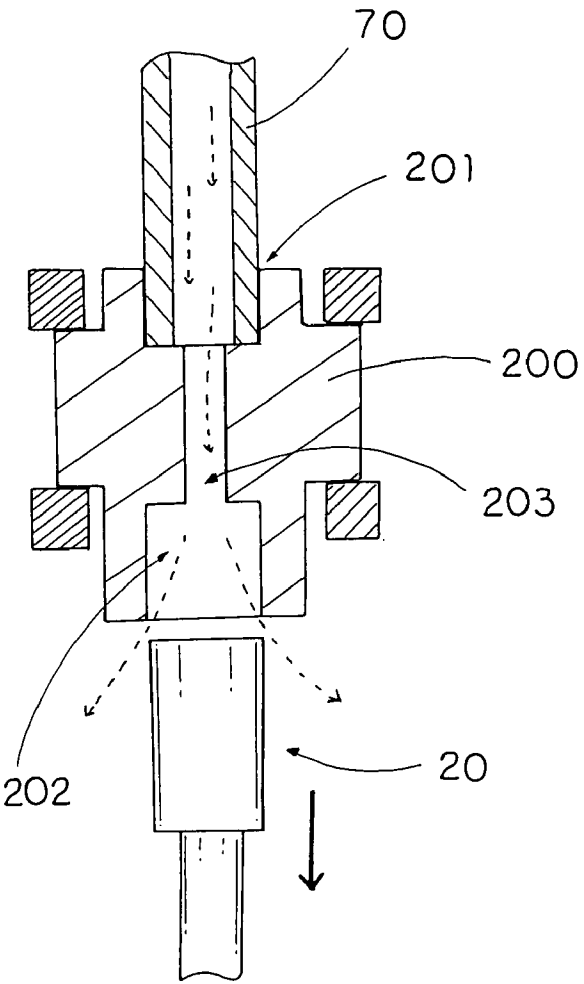
FIG. 5A and FIG. 5B are schematic diagrams of a gas by-pass element of the utility lighter according to the above preferred embodiment of the present invention.
Figure 5A:
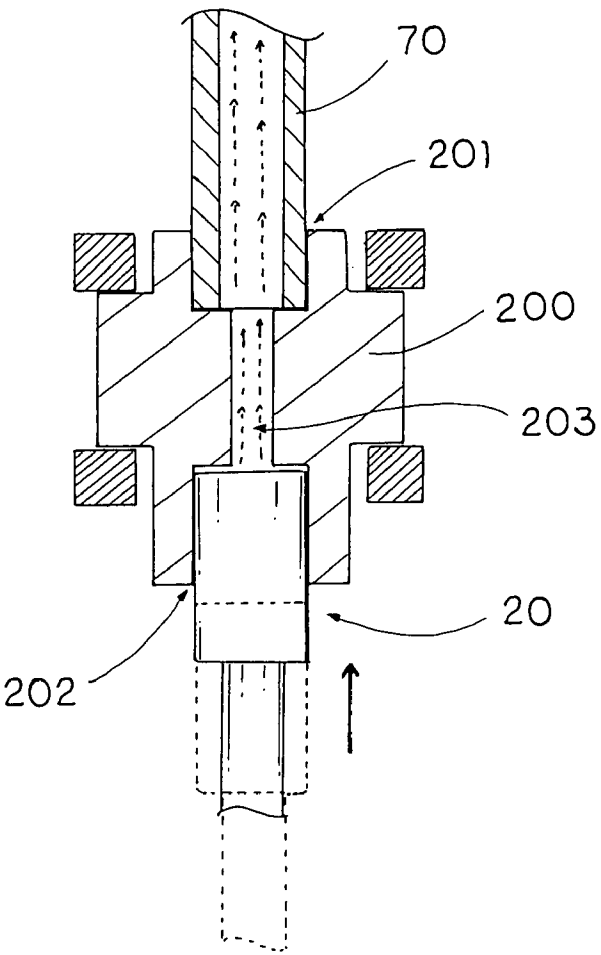

Referring to FIG. 5A and FIG. 5B of the drawings, in order to further ensure safety operation of the present invention, the utility lighter further comprises a gas by-pass element 200 mounted at the flexible gas tube 70 to operatively communicate with the gas releasing valve 20 for allowing safety release of excessive gas through a gas by-pass passageway 203 when the utility lighter has been ignited. More specifically, the gas by-pass element 200 has a top safety chamber 201, a bottom safety chamber 202, and the gas by-pass passageway 203 extended between the top safety chamber 201 and the bottom safety chamber 202, wherein the top safety chamber 201 is connected to a bottom end of the flexible gas tube 70, while the bottom safety chamber 202 is detachably engaged with the gas releasing valve 20, in such a manner that the gas releasing valve 20 is normally disengaged from the gas by-pass element 200, and when the gas releasing valve 20 is lifted up, the gas releasing valve 20 is pushed to engage with the bottom safety chamber 201 of the gas by-pass element 200 so as allow the gas to reach flexible gas tube 70 via the gas by-pass passageway 203, and when the gas releasing valve 20 restores to its original position when ignition of the utility light has completed, the gas releasing valve 20 disengages from the gas by-pass element 200 again. Residual or excessive gas retained within the flexible gas tube 70 is allowed to release to the handling casing 10 through the gas by-pass passageway 203 and the bottom safety chamber 202 so as to prevent residual ignition at the torch nozzle 40.

Moreover, it is worth mentioning that the utility lighter further comprises a gas adjusting device 100 provided at the handle casing 10 to operatively connect with the gas releasing valve 20 to adjustably control the rate at which the gas is released. Thus, a user is able to control a magnitude of the torch flame by controlling the flow rate of the gas released from the gas releasing valve 20.

In view of the above, it can be appreciated that the utility lighter of the present invention is able to ignite a torch flame at a distance from the handle casing wherein an the torch flame is directed at a longitudinal direction of the bendable extension arm 30 so that the user is able to accurately predict the direction of ignition.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A utility lighter, comprising:

a handle casing having a fuel storage compartment formed therein for storing a predetermined amount of liquefied gas;

a gas releasing valve provided at said fuel storage compartment for releasing said gas therein in a controllable manner;

a bendable extension arm having an upper end and a lower end extended from said handle casing, wherein said extension arm has a deformable receiving channel which is extended from said lower end to said upper end and is adapted to be curved when said extension arm is selectively bent between said upper end and said lower end;

a torch nozzle provided at said upper end of said extension arm to communicate with said gas releasing valve through said receiving channel for releasing said gas through said torch nozzle;

a piezoelectric unit, which is supported in said handle casing, having a depressible part and a spark-generating element extended at a position that when said depressible part of said piezoelectric unit is depressed, said spark-generating element generates a spark at said torch nozzle to ignite said gas emitting therefrom so as to generate a torch flame;

an actuation device provided at said lighter casing to operatively couple with said depressible part of said piezoelectric unit and said gas releasing valve, wherein when said extension arm is selectively bent at a desired curvature to adjust a torch pointing direction of said torch nozzle, said actuation device is actuated to depress said depressible part of said piezoelectric unit and to simultaneously release said gas at said gas releasing valve to produce said torch flame at said nozzle torch at said torch pointing direction, wherein said actuation device comprises an actuation button movably supported at said handle casing to depress said depressible part of said piezoelectric unit and to simultaneously release said gas releasing nozzle, and a safety arrangement comprising a blocking member slidably mounted at said handle casing between said safety position and an ignition position, and a resilient element supported in said handle casing for applying an urging force against said blocking member to retain said blocking member at said safety position, wherein at said safety position, said blocking member is retained at position to block said actuation button being depressed, and at said ignition position, said blocking member is transversely slid away from said actuation button such that said actuation button is adapted to be depressed for ignition;

a heat insulating member provided at said upper end of said bendable extension arm to support said torch nozzle for blocking heat generated by said torch flame so as to prevent said heat transmitting to said bendable extension arm;

a heat dissipating windshield, which is made of heat conductive metal, having a surrounding wall mounted at said upper end of said bendable extension arm to enclose said torch nozzle and a top opening which is aligned with an emitting end of said torch nozzle and is arranged when said gas is emitted at said emitting end of said torch nozzle to form said torch flame towards said top opening of said heat dissipating windshield, said heat of said torch flame is conducted and dissipated around said surrounding wall of said heat dissipating windshield for minimizing said heat being transmitted towards said bendable extension arm, wherein said spark-generating element is extended at a position to communicate with said surrounding wall of said heat dissipating windshield such that said surrounding wall enhances a spark initiating surface for igniting said gas emitting from said torch nozzle when said depressible part of said piezoelectric unit is depressed; and a gas by-pass element having a top safety chamber mounted with said flexible has tube, a bottom safety chamber, and a gas by-pass passageway extended between said top safety chamber and said bottom safety chamber, wherein said bottom safety chamber is detachably engaged with said gas releasing valve, in such a manner that said gas releasing valve is normally disengaged from said gas by-pass element, and when said gas releasing valve is lifted up, said gas releasing valve is pushed to engage with said bottom safety chamber for allowing said gas to reach said flexible gas tube via said gas by-pass passageway for generating an ignition at said nozzle torch nozzle, and when said gas releasing valve restores to an original position when said ignition is completed, said gas releasing valve disengages from said gas by-pass element for releasing residual gas retained within said flexible gas tube.

2. A utility lighter, comprising:

a handle casing having a fuel storage compartment formed therein for storing a predetermined amount of liquefied gas;

a bendable extension arm having an upper end and a lower end extended from said handle casing, wherein said extension arm has a deformable receiving channel which is extended from said lower end to said upper end and is adapted to be curved when said extension arm is arranged to be selectively bent between said upper end and said lower end, wherein said bendable extension arm further comprises a tubular flexible arm body having a bendable core portion and a spiral portion extended on said core portion from said lower end to said upper end to divide said arm body into a corresponding number of bending sections to be selectively bent at a predetermined curvature;

a gas releasing valve which is provided at said fuel storage compartment for releasing said gas therein in a controllable manner;

a torch nozzle provided at said upper end of said extension arm to communicate with said gas releasing valve through said receiving channel for releasing said gas through said torch nozzle, wherein said gas releasing valve comprises a flexible gas tube extended to said torch nozzle through said bendable extension arm such that when said bendable extension arm is bent at a desired curvature, said flexible gas tube is correspondingly bent for guiding said gas emitting from said gas releasing valve to said torch nozzle inside said bendable extension arm;

a piezoelectric unit, which is supported in said handle casing, having a depressible part and a spark-generating element extended at a position that when said depressible part of said piezoelectric unit is depressed, said spark-generating element generates a spark at said torch nozzle to ignite said gas emitting therefrom so as to generate a torch flame; and an actuation device provided at said lighter casing to operatively couple with said depressible part of said piezoelectric unit and said gas releasing valve, wherein when said extension arm is selectively bent at a desired curvature to adjust a torch pointing direction of said torch nozzle, said actuation device is actuated to depress said depressible part of said piezoelectric unit and to simultaneously release said gas at said gas releasing valve to produce said torch flame at said nozzle torch at said torch pointing direction, wherein said actuation device comprises an actuation button movably supported at said handle casing to depress said depressible part of said piezoelectric unit and to simultaneously release said gas releasing nozzle, and a safety arrangement comprising a blocking member slidably mounted at said handle casing between said safety position and an ignition position, and a resilient element supported in said handle casing for applying an urging force against said blocking member to retain said blocking member at said safety position, wherein at said safety position, said blocking member is retained at position to block said actuation button being depressed, and at said ignition position, said blocking member is transversely slid away from said actuation button such that said actuation button is adapted to be depressed for ignition;

a heat insulating member provided at said upper end of said bendable extension arm to support said torch nozzle for blocking heat generated by said torch flame so as to prevent said heat transmitting to said bendable extension arm;

a heat dissipating windshield, which is made of heat conductive metal, having a surrounding wall mounted at said upper end of said bendable extension arm to enclose said torch nozzle and a top opening which is aligned with an emitting end of said torch nozzle and is arranged when said gas is emitted at said emitting end of said torch nozzle to form said torch flame towards said top opening of said heat dissipating windshield, said heat of said torch flame is conducted and dissipated around said surrounding wall of said heat dissipating windshield for minimizing said heat being transmitted towards said bendable extension arm, wherein said spark-generating element is extended at a position to communicate with said surrounding wall of said heat dissipating windshield such that said surrounding wall enhances a spark initiating surface for igniting said gas emitting from said torch nozzle when said depressible part of said piezoelectric unit is depressed, wherein said heat dissipating windshield further has a plurality of heat dissipating slots spacedly formed on said surrounding wall in an array that each two of said adjacent heat dissipating slots are formed on every other column defined by each of said heat dissipating slots for slowing down said heat transmitting towards said bendable extension arm, such that when said torch nozzle emits said gas to form said torch flame towards said top opening, said heat dissipating windshield creates a sucking effect to suck surrounding air entering into said heat dissipating windshield through said heat dissipating slots so as to cool down said surrounding wall of said heat dissipating windshield, and said spark-generating element being extended to said lower end of said bendable extension arm to communicate with said heat dissipating windshield such that said bendable extension arm forms a conductive medium to transmit piezoelectricity to said heat dissipating windshield;

a sealing member mounted at said lower end of said bendable extension arm to seal at said handle casing for blocking said heat from said torch flame through said extension arm towards said handle casing; and a gas by-pass element having a top safety chamber mounted with said flexible has tube, a bottom safety chamber, and a gas by-pass passageway extended between said top safety chamber and said bottom safety chamber, wherein said bottom safety chamber is detachably engaged with said gas releasing valve, in such a manner that said gas releasing valve is normally disengaged from said gas by-pass element, and when said gas releasing valve is lifted up, said gas releasing valve is pushed to engage with said bottom safety chamber for allowing said gas to reach said flexible gas tube via said gas by-pass passageway for generating an ignition at said nozzle torch nozzle, and when said gas releasing valve restores to an original position when said ignition is completed, said gas releasing valve disengages from said gas by-pass element for releasing residual gas retained within said flexible gas tube.

3. A utility lighter, comprising:

a handle casing having a fuel storage compartment formed therein for storing a predetermined amount of liquefied gas;

a gas releasing valve provided at said fuel storage compartment for releasing said gas therein in a controllable manner;

a bendable extension arm having an upper end and a lower end extended from said handle casing, wherein said extension arm has a deformable receiving channel which is extended from said lower end to said upper end and is adapted to be curved when said extension arm is selectively bent between said upper end and said lower end;

a torch nozzle provided at said upper end of said extension arm to communicate with said gas releasing valve through said receiving channel for releasing said gas through said torch nozzle;

a piezoelectric unit, which is supported in said handle casing, having a depressible part and a spark-generating element extended at a position that when said depressible part of said piezoelectric unit is depressed, said spark-generating element generates a spark at said torch nozzle to ignite said gas emitting therefrom so as to generate a torch flame;

an actuation device provided at said lighter casing to operatively couple with said depressible part of said piezoelectric unit and said gas releasing valve, wherein when said extension arm is selectively bent at a desired curvature to adjust a torch pointing direction of said torch nozzle, said actuation device is actuated to depress said depressible part of said piezoelectric unit and to simultaneously release said gas at said gas releasing valve to produce said torch flame at said nozzle torch at said torch pointing direction;

a gas by-pass element having a top safety chamber mounted with said flexible has tube, a bottom safety chamber, and a gas by-pass passageway extended between said top safety chamber and said bottom safety chamber, wherein said bottom safety chamber is detachably engaged with said gas releasing valve, in such a manner that said gas releasing valve is normally disengaged from said gas by-pass element, and when said gas releasing valve is lifted up, said gas releasing valve is pushed to engage with said bottom safety chamber for allowing said gas to reach said flexible gas tube via said gas by-pass passageway for generating an ignition at said nozzle torch nozzle, and when said gas releasing valve restores to an original position when said ignition is completed, said gas releasing valve disengages from said gas by-pass element for releasing residual gas retained within said flexible gas tube; and a heat insulating member provided at said upper end of said bendable extension arm to support said torch nozzle for blocking heat generated by said torch flame so as to prevent said heat transmitting to said bendable extension arm.

4. The utility lighter, as recited in claim 3, further comprising a heat dissipating windshield, which is made of heat conductive metal, having a surrounding wall mounted at said upper end of said bendable extension arm to enclose said torch nozzle and a top opening which is aligned with an emitting end of said torch nozzle and is arranged when said gas is emitted at said emitting end of said torch nozzle to form said torch flame towards said top opening of said heat dissipating windshield, said heat of said torch flame is conducted and dissipated around said surrounding wall of said heat dissipating windshield for minimizing said heat being transmitted towards said bendable extension arm.

5. The utility lighter, as recited in claim 4, wherein said spark-generating element is extended at a position to communicate with said surrounding wall of said heat dissipating windshield such that said surrounding wall enhances a spark initiating surface for igniting said gas emitting from said torch nozzle when said depressible part of said piezoelectric unit is depressed.

6. The utility lighter, as recited in claim 5, wherein said heat dissipating windshield further has a plurality of heat dissipating slots spacedly formed on said surrounding wall in an array that each two of said adjacent heat dissipating slots are formed on every other column defined by each of said heat dissipating slots for slowing down said heat transmitting towards said bendable extension arm, such that when said torch nozzle emits said gas to form said torch flame towards said top opening, said heat dissipating windshield creates a sucking effect to suck surrounding air entering into said heat dissipating windshield through said heat dissipating slots so as to cool down said surrounding wall of said heat dissipating windshield.

7. The utility lighter, as recited in claim 6, further comprising a sealing member mounted at said lower end of said bendable extension arm to seal at said handle casing for blocking heat from said torch flame through said extension arm towards said handle casing.

8. The utility lighter, as recited in claim 7, wherein said bendable extension arm comprises a tubular flexible arm body having a bendable core portion and a spiral portion extended on said core portion from said lower end to said upper end to divide said arm body into a corresponding number of bending sections to be selectively bent at a predetermined curvature.

9. The utility lighter, as recited in claim 8, wherein said spark-generating element is extended to said lower end of said bendable extension arm to communicate with said heat dissipating windshield such that said bendable extension arm forms a conductive medium to transmit piezoelectricity to said heat dissipating windshield.

10. The utility lighter, as recited in claim 9, wherein said actuation device comprises an actuation button movably supported at said handle casing to depress said depressible part of said piezoelectric unit and to simultaneously release said gas releasing nozzle, and a safety arrangement comprising a blocking member slidably mounted at said handle casing between said safety position and an ignition position and a resilient element supported in said handle casing for applying an urging force against said blocking member to retain said blocking member at said safety position, wherein at said safety position, said blocking member is retained at position to block said actuation button being depressed, and at said ignition position, said blocking member is transversely slid away from said actuation button such that said actuation button is adapted to be depressed for ignition.

* * * * *